US005715700A

United States Patent [19]

Credle, Jr.

[11] Patent Number: 5,715,700

[45] Date of Patent: Feb. 10, 1998

[54] ROUND DRINK DISPENSER

[75] Inventor: William S. Credle, Jr., Stone Mountain, Ga.

[73] Assignee: The Coca-Cola Company, Atlanta, Ga.

[21] Appl. No.: 462,886

[22] Filed: Jun. 5, 1995

[51] Int. Cl.[6] ..... B67D 5/62

[52] U.S. Cl. ..... 62/390; 62/399; 62/396; 222/146.6; 222/129.1

[58] Field of Search ..... 62/389, 390, 392, 62/394, 396, 399; 222/146.6, 129.1; 261/DIG. 7

[56] References Cited

U.S. PATENT DOCUMENTS

| | | | |
|---|---|---|---|
| D. 63,657 | 12/1923 | Root . | |
| D. 67,557 | 6/1925 | Travis . | |
| D. 75,151 | 5/1928 | Cordley . | |
| D. 82,798 | 12/1930 | Crosby . | |
| D. 87,246 | 6/1932 | Wagner . | |
| D. 323,267 | 1/1992 | Bidwell . | |
| D. 338,137 | 8/1993 | Ochs . | |
| D. 347,362 | 5/1994 | Redmon . | |
| D. 349,218 | 8/1994 | Evans . | |
| D. 355,793 | 2/1995 | Flum . | |
| 2,328,110 | 8/1943 | Thompson et al. | 62/390 |
| 2,541,757 | 2/1951 | Grier | 62/396 |
| 2,586,499 | 2/1952 | Anderson | 62/394 |
| 3,215,312 | 11/1965 | Guzzi | 62/390 |
| 3,280,587 | 10/1966 | Booth et al. | 62/395 |
| 3,550,393 | 12/1970 | Euwema | 62/396 |
| 3,898,861 | 8/1975 | McMillin | 222/146.6 |
| 3,926,342 | 12/1975 | Selvia et al. | 222/129.1 |
| 3,995,441 | 12/1976 | McMillin | 62/177 |
| 4,437,319 | 3/1984 | Iannelli | 62/138 |
| 4,699,282 | 10/1987 | Farrar . | |
| 4,801,048 | 1/1989 | Credle et al. | 222/129.1 |
| 5,129,552 | 7/1992 | Painchaud et al. | 222/146.6 |
| 5,140,832 | 8/1992 | Deininger et al. | 62/389 |

FOREIGN PATENT DOCUMENTS

| | | |
|---|---|---|
| 3-273481 | 12/1991 | Japan . |

*Primary Examiner*—William Doerrler

*Attorney, Agent, or Firm*—Birch, Stewart, Kolasch & Birch, LLP

[57] ABSTRACT

A round post-mix beverage dispenser includes a cylindrical carbonator, still water conduits for supplying water to be carbonated, and carbonated water output coils in the form of circular courses of tubing which surround the carbonator tank in a surrounding water bath. Syrup conduits are coiled in circular courses within the water bath. The round or cylindrical shape of the dispenser housing is adaptable to many different looks such as cans, bottles, glasses and cups. Preferably the basic cylindrical housing shape is made to look like a can of a beverage. Decorative sleeves which define or simulate the appearance of other types of containers such as bottles, cups and glasses can be easily added to the basic cylindrical housing, as desired, to provide different attractive appearances to promote sales.

28 Claims, 18 Drawing Sheets

ROUND DRINK DISPENSER

BACKGROUND OF THE INVENTION

The present invention relates to a compact post-mix drink dispenser with improved marketing appeal, easy-change graphics, smaller footprint, refrigeration efficiency, easier service and lower manufacturing costs. More specifically, the present invention relates to a compact drink dispenser having a cylindrical-shaped housing which can simulate a shape of various beverage containers such as cans, bottles, cups or glasses; and which has circular flow paths of product and cooling fluids to ensure more efficient refrigeration of the products being dispensed.

The majority of existing post-mix beverage drink dispensers have box-like housings which are formed from ten or more pieces of sheet metal requiring as many as thirty bending operations in order to secure the panels together in a fluid-type manner. These structures are relatively expensive to manufacture.

These conventional box-like housings also generally include fixed product graphics on the front and sidewalls thereof, which need to be shipped to refurbishment centers in order to change the graphics to provide any desired new looks.

Many of these known beverage dispensers also include rather complex built-in refrigeration systems within the housing which are difficult to service.

In addition box-like, rectangular housings require a larger footprint than needed because of dead space in the corners of the housings. Therefore, box-like housings take up more space on the counter of a fast food restaurant than desirable.

Furthermore the box-like housings usually include rectangular-shaped product cooling lines and evaporator coils which track the rectangular contour of the box-like housings. Rectangular flow paths therein include dead corners in the water bath and abrupt bends in the product cooling lines which create large pressure drops.

In addition the box-like housings require a larger water bath than needed due to the presence of the dead corners in the rectangular housings. This results in slower cool down of the water and less predictability of the ice bank shape and inside surface characteristics.

In box-like housings the ice bank tries to form a round inner surface. But this can cause freezing of the water (soda) and syrup, thus stopping or reducing the flow of the water or syrup therein.

Many existing drink dispensers utilizing refrigerated water baths also need improved carbonator devices for use in those water baths. It would be desirable to be able to reduce the number of required components of those carbonators and the heat transfer efficiency thereof.

Generally compact drink dispensers also utilize a single dispenser nozzle for dispensing plural products resulting in flavor carry over problems.

Existing drink dispensers having refrigerated water baths generally place flow control regulators downstream of the product cooling lines therein because they are more accessible and less cumbersome to manually adjust. However, if this adjustment problem could be solved it would be advantageous to place the flow regulators upstream of the water bath where temperatures are higher. As is known small changes in low temperatures of fluids create large changes in viscosity; but this is not true for high temperatures.

While some drink dispensers are known in the art which utilize cylindrical housings and associated cylindrical carbonators, such devices do not recognize all of the potential advantages of these cylindrical shapes which are useful in overcoming the above described problems of box-like housing structures.

Accordingly, a need in the art exists for a compact drink dispenser which overcomes all of the above disadvantages of box-like drink dispenser structures associated with the majority of the commercial post-mix dispenser units in the marketplace.

SUMMARY OF THE INVENTION

Accordingly, it is a primary object of the present invention to provide a compact post-mix drink dispenser having a shape which lends itself to improved marketing appeal, easy-change graphics panels, easier service, low-cost manufacturing techniques, a smaller footprint, increased efficiency of the refrigeration assembly, and improved flow control of the product constituents.

It is another object of the present invention to provide a cylindrical housing for a refrigeration water bath, which improves the circulation of water therein since there are no dead corners as in rectangular housings.

It is another object of the present invention to provide a drink dispenser having a shape wherein the product graphics thereon is displayed throughout the 360° of the sidewalls precluding the existence of any visually bad sides.

It is a further object of the present invention to provide a beverage dispenser having a shape which simulates various containers for serving the product being dispensed, the type of simulated container being changeable as desired.

It is yet another object of the present invention to provide flat or pre-rolled graphics panels which may be warehoused separately from the dispenser and shipped separately or along with the dispenser as easy-change panels to facilitate changing of graphics in order to achieve a new look when it is desired to run a special or new promotion of the products.

It is still another object of the present invention to provide a compact drink dispenser made from fewer housing component portions to reduce the number of bending operations required and thus the overall cost of manufacture.

It is still another object of the present invention to provide an improved carbonator tank for use in the water bath of a post-mix beverage dispenser which has an increased carbon dioxide/water interface, larger capacity, more surface contact area between its housing and the surrounding water bath, and thus better heat transfer, and no need for a separate baffle to protect or isolate the liquid level probes and soda water dip tube from remaining portions of the carbonated water reservoir.

The objects of the invention are fulfilled by providing a refrigeration assembly for a post-mix beverage dispenser comprising a cylindrical housing for containing a supply of water forming a water bath;

a cylindrical carbonator tank disposable within said cylindrical housing and the water bath, said carbonator tank including first and second concentric cylinders defining an annular chamber for carbonated water therebetween, an inner one of the concentric cylinders defining a central bore for accommodating refrigerated water from the water bath therein; and a circular evaporator coil concentrically disposed about the cylindrical housing for cooling the water in the water bath and the carbonator tank and forming a cylindrical ice bank about an inner surface of the housing;

major flow paths of water through each of the cylindrical housing, the carbonator tank and evaporator coil being circular without any flow impeding corners or bends in said paths.

High maintenance components of the refrigeration assembly are removably disposed in the cylindrical housing of the dispenser as a modular unit to facilitate ease of service. These components are removable separately from the freon (coolant) circulating components. The post-mix beverage dispenser further includes still water conduits for supplying water to be carbonated to the carbonator tank and carbonated water output coils in the form of circular courses of tubing which surround the carbonator tank in the surrounding water bath. Syrup conduits are also provided and are coiled in circular courses within the water bath. In one embodiment in-line flow regulators are provided upstream of the water bath in order to regulate the flow of water and syrup to the water bath and thus to dispenser valves at the output of the water bath.

Because major flow paths of water and syrup through the water and syrup cooling coils are circular and have no flow impeding bends or restrictions to create large pressure drops, this results in higher soda and syrup pressures at the flow control dispensing valves assembly allowing for better control of ratio. Also the cylindrical shape of the water bath has no dead corners and the ice bank formed therein has a smooth cylindrical inner surface and a substantially uniform thickness. These factors in combination with an annular carbonator and circular syrup and water cooling coils leads to efficient water circulation in the bath and a more compact arrangement and decreased risk of freeze-up of syrup and water cooling coils.

Another important aspect of the present invention is to provide a cabinet assembly having a shape which is conducive to improved marketing appeal. The round or cylindrical shape of the dispenser housing is adaptable to many different looks such as cans, bottles, glasses and cups. In addition if the basic cylindrical housing shape is made to look like a can of beverage, that can be used as a base for decorative sleeves which define or simulate the appearance of other types of containers such as bottles, cups and glasses.

In addition, the use of decorative sleeves can further enhance marketing appeal by utilizing transparent sleeves and fluids between the sleeve and the cylindrical housing which simulate the appearance of a carbonated beverage.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention and wherein.

DESCRIPTION OF PREFERRED EMBODIMENTS

Figure 1:
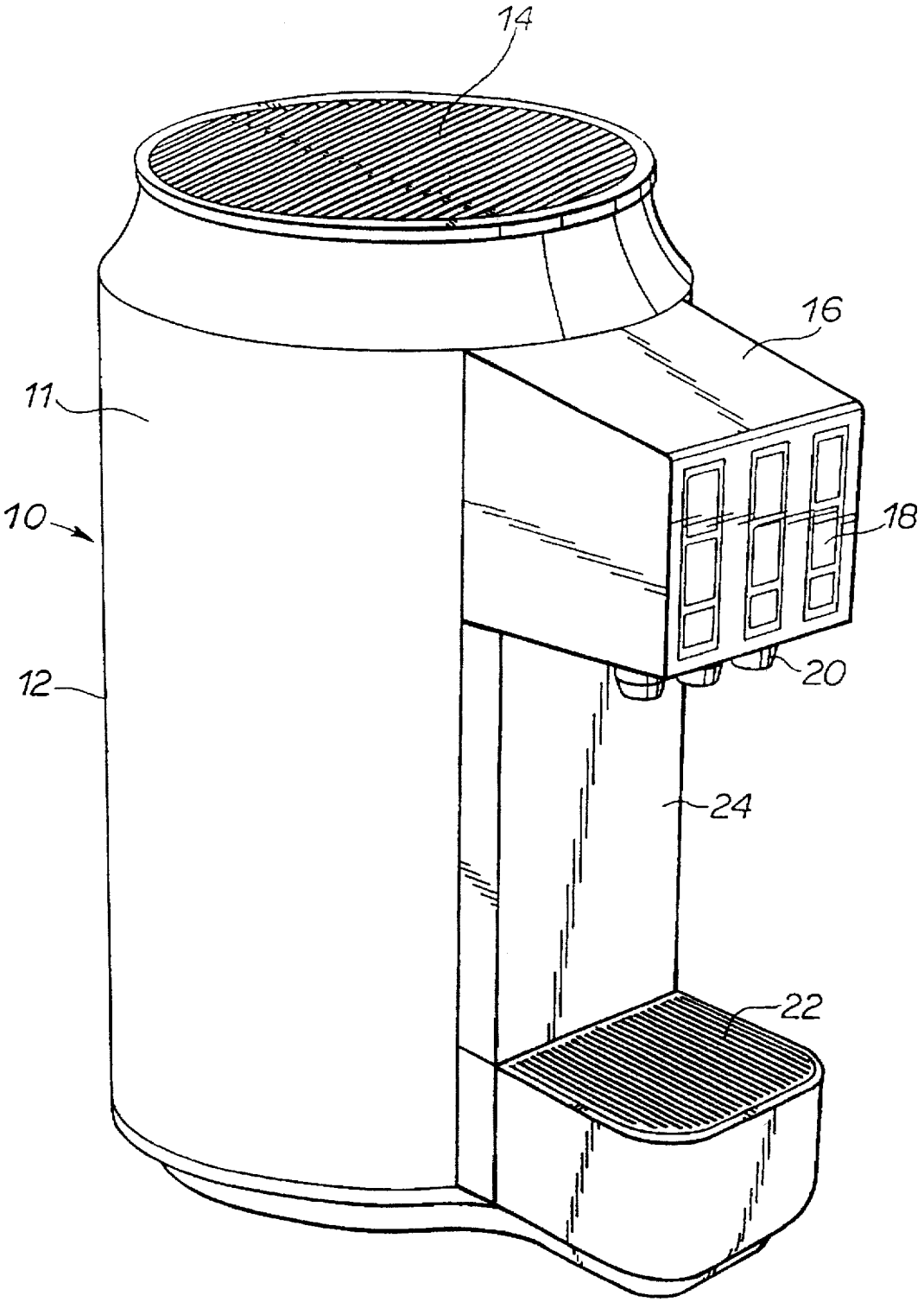
FIG. 1 is a perspective view of a preferred embodiment of the beverage dispenser of the present invention illustrating a cylindrical housing which simulates the appearance of a beverage can.

Referring to FIG. 1 there is illustrated a preferred embodiment of the beverage dispenser of the present invention generally indicated 10. A cylindrical housing 12 is shaped like a conventional soft-drink beverage can in order to enhance marketing appeal as compared to the box-like housings generally utilized in existing commercial dispensers. With the cylindrical housing 12 the consumer can see 360° of graphics and there are no bad sides. In addition the simulated shape of a beverage can, or other container shapes to be described hereinafter, attract the customer to the dispenser and increase potential sales.

Another advantage of the cylindrical housing 12 is that it enables the graphics 12A thereon to be easily changed in the field. Current dispensers must be removed and shipped to a refurbishment center before they get a new look. However, with the cylindrical shaped housing of the present invention flat panels or pre-rolled graphic panels may be shipped into the field and new panels may be easily substituted whenever it is desired to run a promotion or change the display for some other reason.

The dispenser of FIG. 1 is also provided with a dispenser valve assembly 16 with flavor selection buttons 18 and a dispensing nozzle 20 on the underside thereof. Connecting the dispenser valve assembly 16 to a drip tray 22 is a splash plate 24. The dispenser valve assembly 16, splash plate 24, and drip tray 22 are suitably secured to the inner structure of the cylindrical housing 12.

A removable sleeve 11 with graphics thereon is secured about cylinder 12. Sleeve 11 is preferably a pre-rolled graphics panel which may be warehoused separately from the dispenser. This provides increased flexibility for changing panels in the field and also allows for producing one single dispenser for world-wide use because different graphics panels can be easily installed in the warehouse or at the point of installation.

As will be described more fully hereinafter the nozzles 20 may include a plurality of nozzles for different respective flavors if desired in accordance with the illustrations of FIGS. 17B and 17C. In the alternative a single nozzle could be used as indicated in FIG. 17A.

Figure 2:
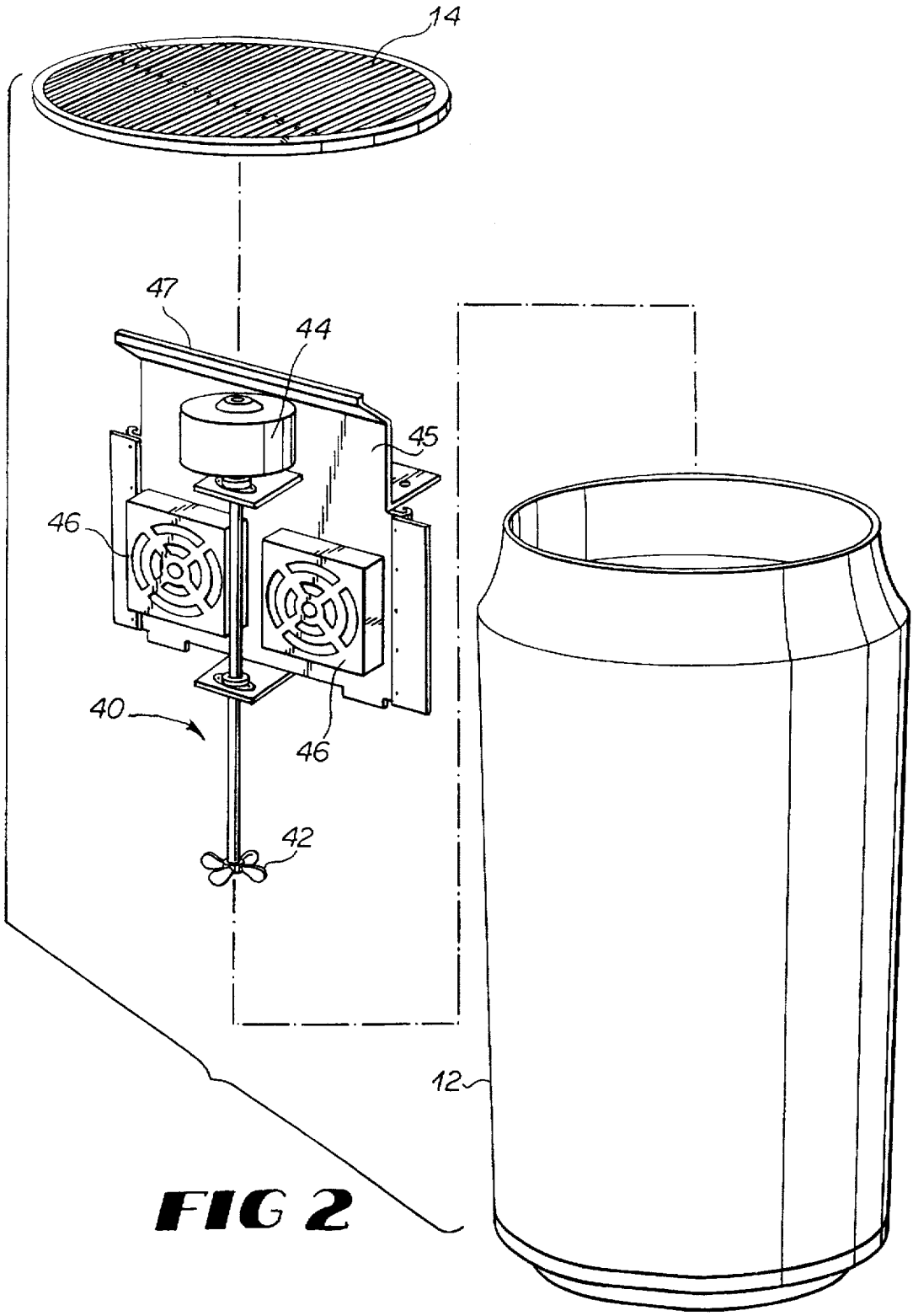
FIG. 2 is a partial exploded view of FIG. 1 showing the agitator/fan assembly of the present invention.

The top of housing 12 is provided with a grille 14 permitting air flow to and from housing 12. The exploded view of FIG. 2 shows how grille 14 is removable for insertion or removal of agitator assembly 40 including impeller 42 and motor 44 mounted on a bracket 45. Also mounted on bracket 45 are a pair of condenser fan-motor units 46. The top of bracket 45 is curved to form a baffle 47. Other high maintenance electrical components such as a transformer and electrical box may also be mounted on bracket 45, so that non-freon components of the refrigeration system can be readily removed for repair.

Figure 3:
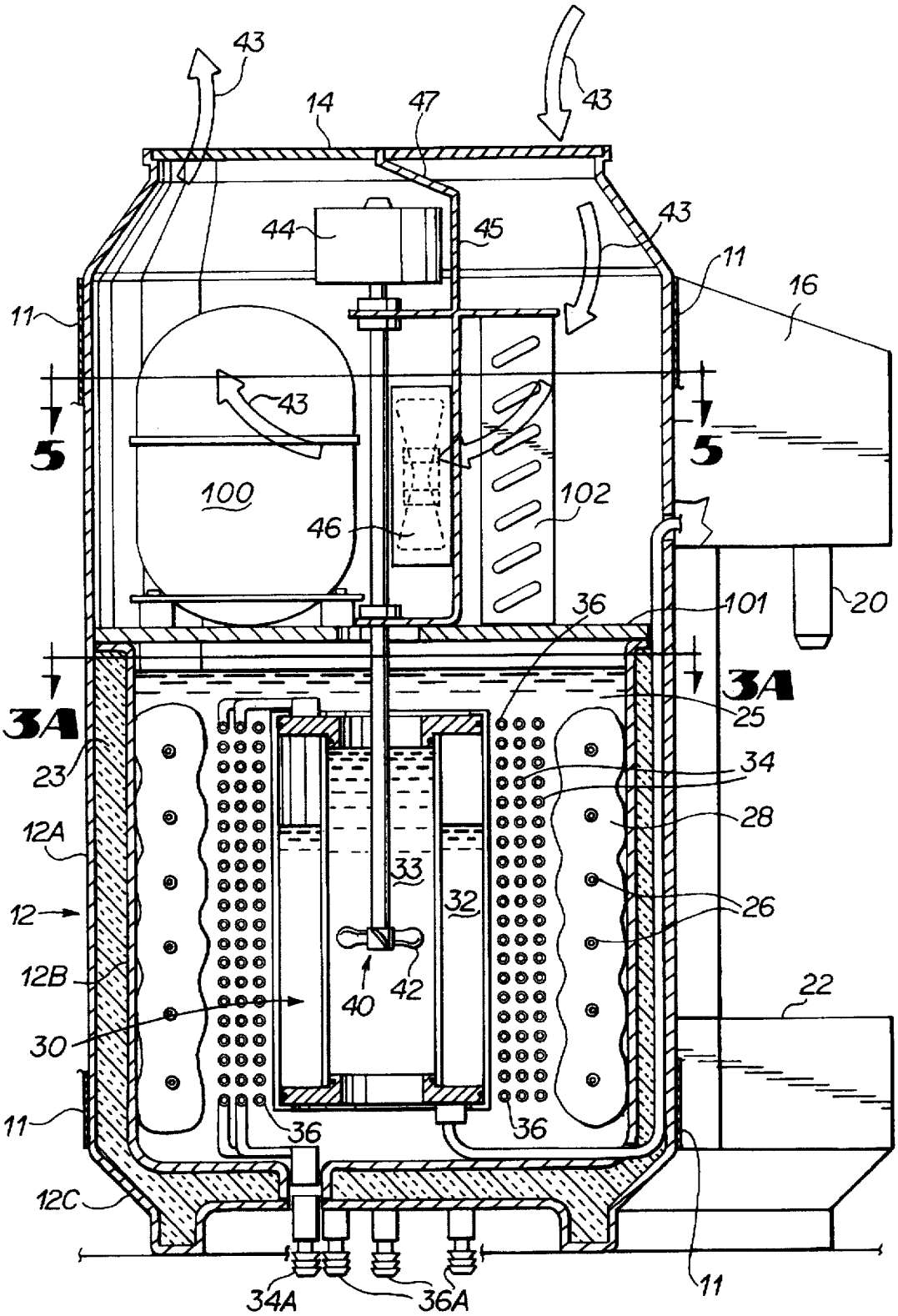
FIG. 3 is a cross-sectional view of one embodiment of the dispenser of FIG. 1.
Figure 3A:
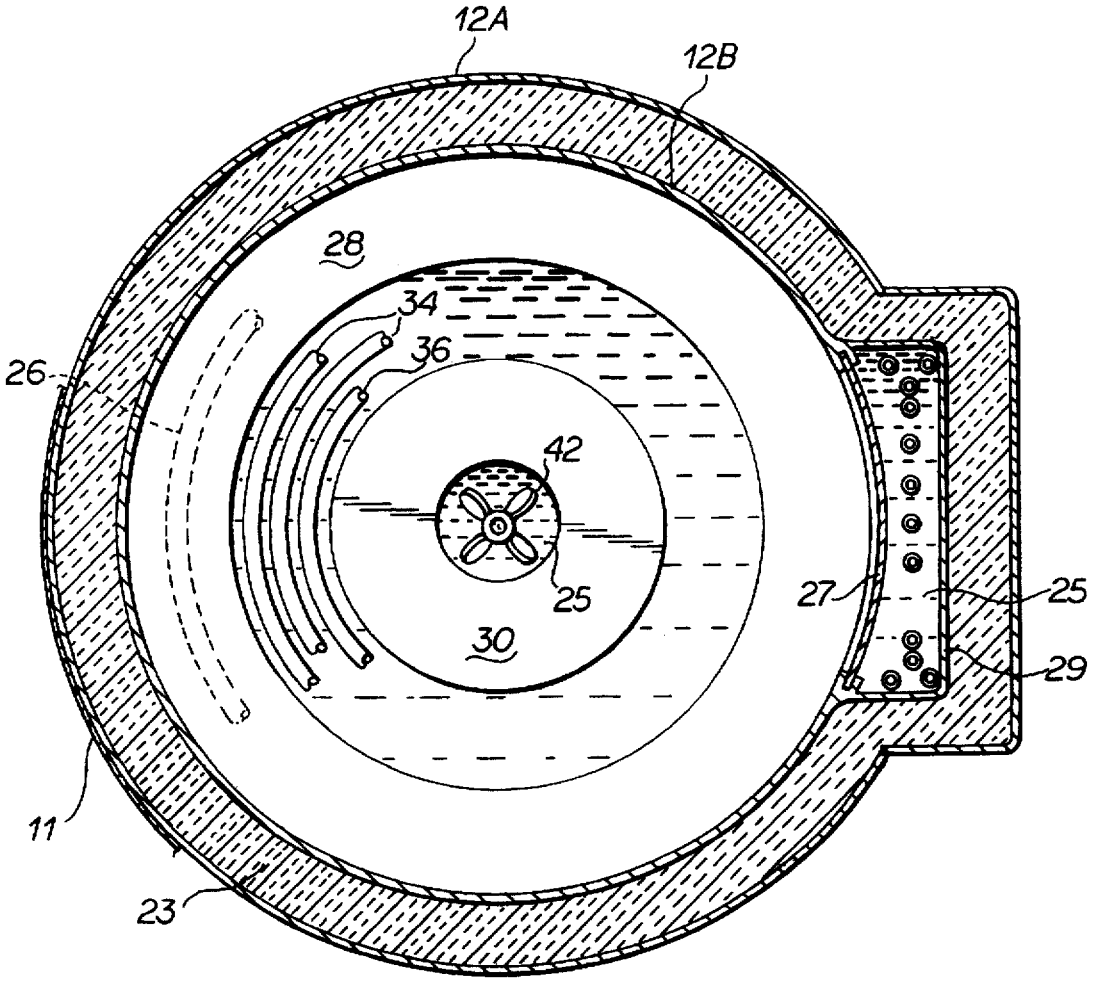
FIG. 3A is a cross-section taken along line 3A—3A of FIG. 3 illustrating the water bath and components therein in top plan.

The cross-sectional views of FIGS. 3 and 3A illustrate the bottom portion of housing 12 and its detailed construction. An alternative embodiment to that of FIG. 3 will be described hereinafter with reference to FIG. 16. Cylinder 12 includes an outer shell 12A and an inner shell 12B concentrically disposed therein defining a space therebetween in which insulation 23 is contained. Outer shell 12A is suitably secured to inner shell 12B. As compared to conventional box-like housings with dispenser water baths this eliminates the multiple bends and joints of housing panels which sometimes totals as many as thirty. Therefore, cylinder 12 of the dispenser of the present invention is much less expensive to manufacture than conventional box-like housing structures.

The concentrically disposed inner shell 12B defines within the interior thereof a chamber for containing a refrigeration water bath 25. Evaporator coils 26 are concentrically disposed in circular courses around the interior of inner shell 12B and form a cylindrical ice bank 28 about coils 26 on the inside surface of shell 12B.

A plurality of syrup supply coils 36 are concentrically disposed in stacked circular courses about carbonator 30. Syrup is supplied to these conduits 36 through input fittings 36A. Alternatively, the syrup conduits 36 can extend up behind splash plate 24, and come in through the top of the water bath; or conduits 36 may be brought in through the front of the dispenser.

A carbonator assembly 30 for use in the dispenser of the present invention is also illustrated in FIG. 3 immersed in the water bath on the central axis of the cylindrical housing 12. Further details of the carbonator tank 30 are illustrated in FIG. 4.

As shown in FIGS. 3 and 3A a pair of circular courses of water supply coils, or conduits 34, for carbonator 30 are concentrically disposed around the outside of carbonator tank 30 within the water bath. These coils or conduits 34 are connected to an input fitting 34A.

Figure 4:
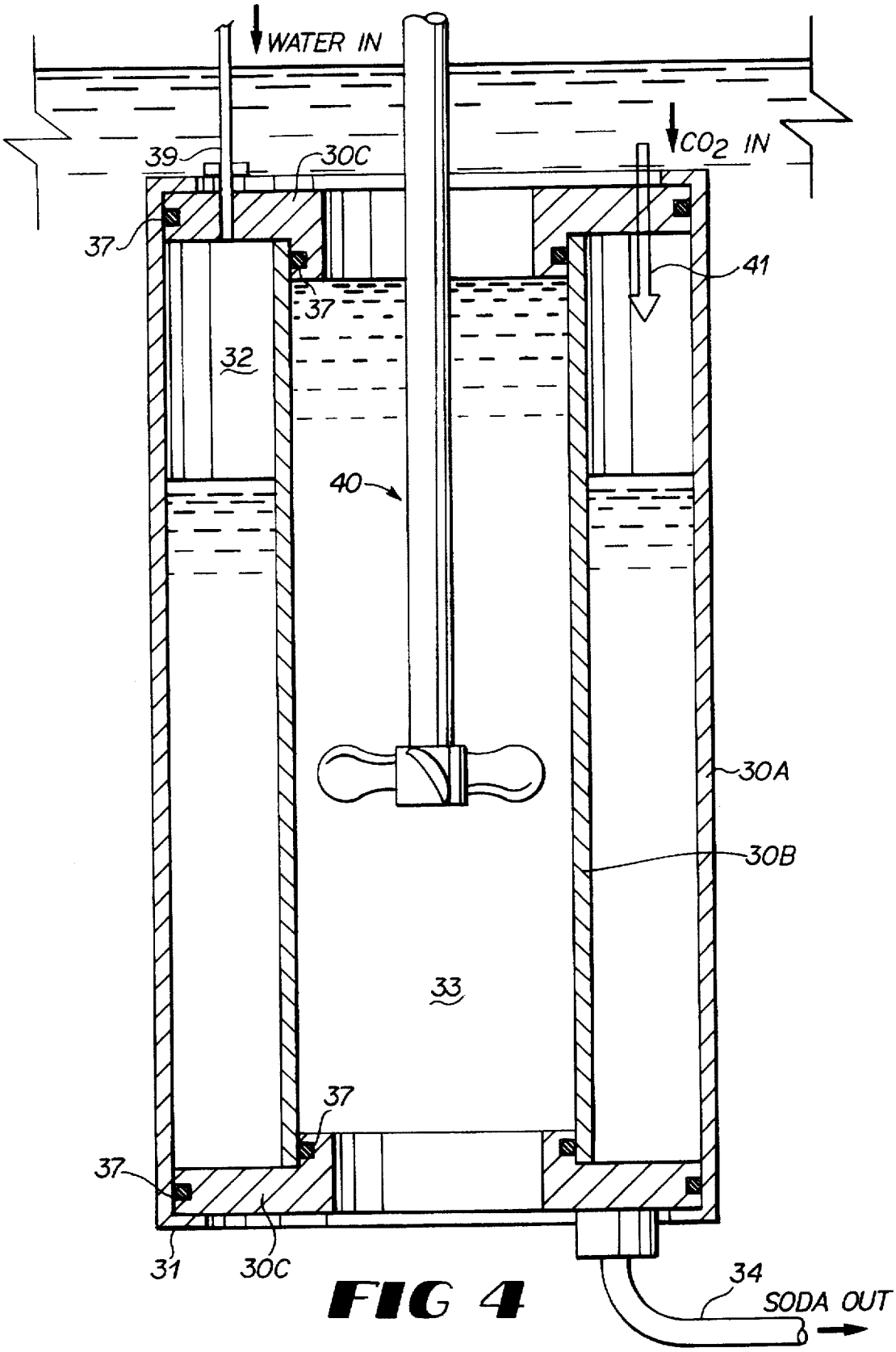
FIG. 4 is a cross-sectional view of the carbonator tank of the present invention.

Carbonator tank 30 has a unique and improved structure illustrated in FIG. 4 as compared to conventional carbonators in that it includes an outer cylinder 30A and an inner cylinder 30B which define a carbonated water reservoir in an annular chamber 32 therebetween. Inner cylinder 30B also defines an axial bore 33 for accommodating the flow of water therethrough from the water bath. This annular or donut shape of the carbonator tank increases the surface area that is exposed to water in the water bath and thus increases the heat transfer efficiency of the carbonator.

Also the inner cylinder 30B acts as a baffle to isolate soda outlet 34 the and liquid level probes (not shown) from the turbulence generated by the incoming water.

The ends 30C of carbonator assembly 30 may be made from plastic of any suitable type with input and output ports or fittings molded therein. End walls 30C may be secured in liquid-tight arrangement in the ends of the cylinder 30A utilizing appropriate O-rings 37, and by simply rolling over the distal ends of outer cylinder 30A to clamp the ends 30C in place. This lowers the cost of manufacture of the carbonator tank.

$CO_2$ gas is supplied to annular chamber 32 in carbonator assembly 30 through a conduit 41. Water to be carbonated is supplied through conduit 39 into carbonator tank 30. Carbonated (soda) water is output from carbonator tank 30 through an output conduit 34.

It can be seen from the illustrations of FIGS. 3, 3A and 4 that all major liquid flow paths are circular and do not include any flow impeding corners or bends as would be present in a rectangular or box-like housing and carbonator construction of the majority of the prior art devices. Serpentine flow paths are also avoided because even with serpentine flow paths the characteristic bends therein have radiuses which are generally less than radiuses achieved with circular flow paths. The use of circular conduits for cooling lines means that there is less pressure drop through a given length of conduit resulting in higher flowing pressures to the dispensing valves, so that flow controls can work better.

The mechanical refrigeration components of the dispenser of the present invention are supported on a deck 101 disposed just above the water bath in the container 12 as illustrated in FIG. 3. These mechanical components include a compressor 100, condenser 102 and a pair of circulation fans 46 separately mounted on a removable bracket 45. Circulation of air, as indicated in the arrows 33 is down through grid 14, condenser 102, fans 46 and out the top of housing 12 through grid 14. Condenser 102 is of course connected in fluid circuit with evaporator coils 26, which create the ice bath 28 in the lower portion of housing 12 as described hereinbefore.

Figure 5:
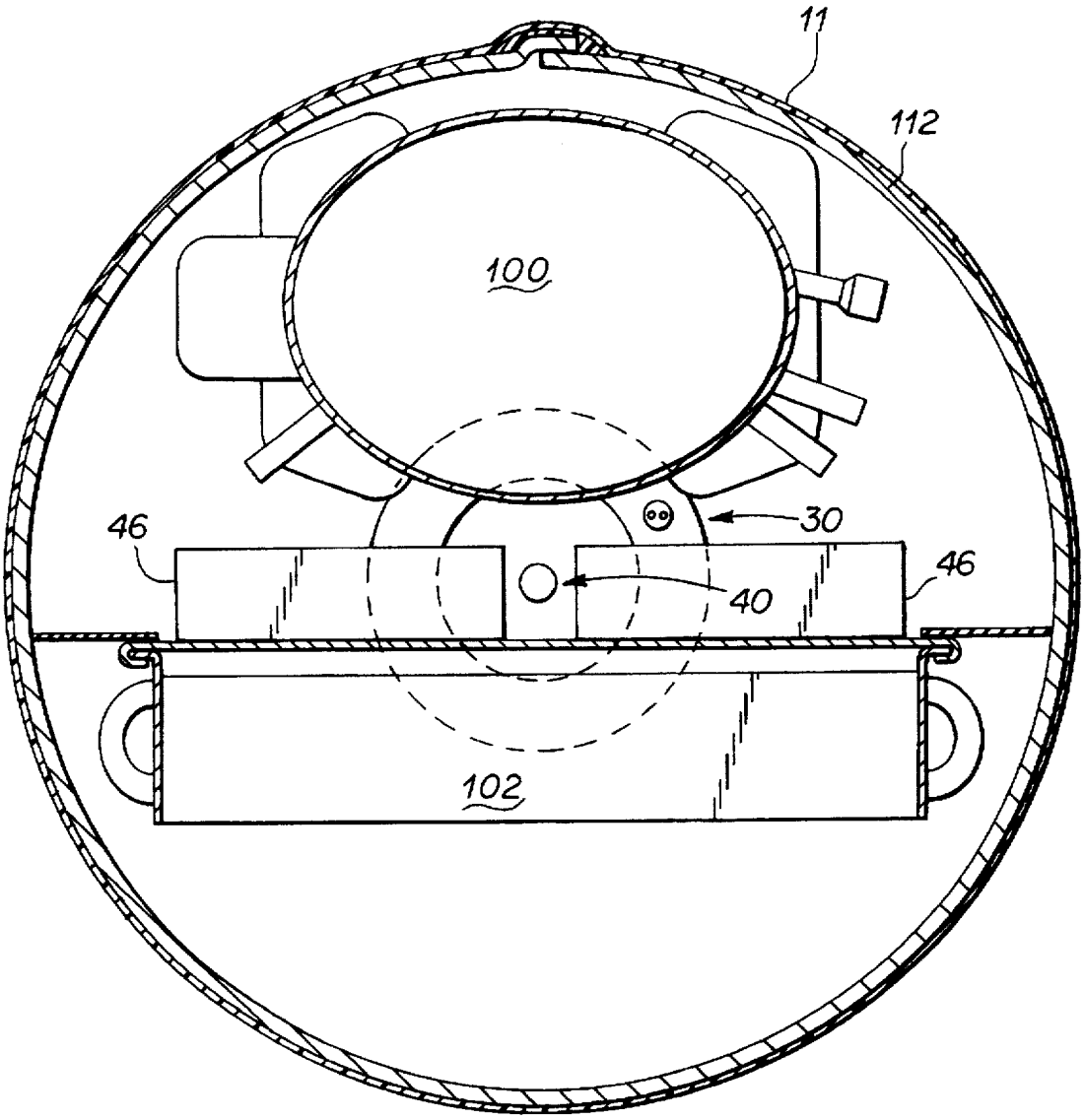
FIG. 5 is a cross-sectional view looking into the top of the beverage dispenser housing of FIG. 3.

The mechanical refrigeration components in the top of housing 12 are also illustrated in FIG. 5 which is a partial cross-sectional view taken along lines 5—5 of FIG. 3. FIG. 5 shows the relative location of components looking down into the top of housing 12.

Figure 6:
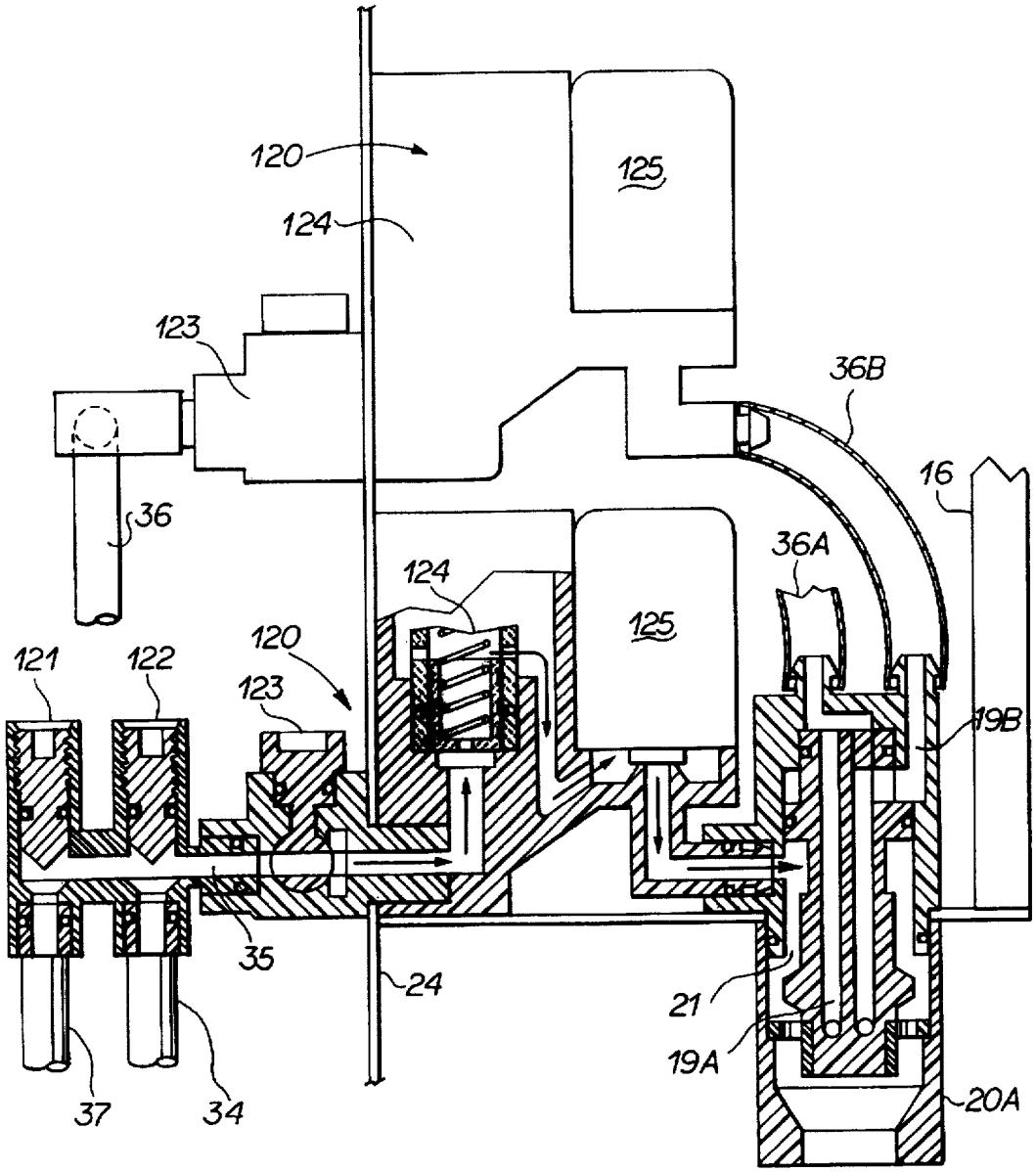
FIG. 6 is a cross-sectional view taken along line 6—6 of FIG. 7 showing details of an embodiment of a valve assembly, flow regulator and mixing nozzle of the present invention for use in the dispenser of FIG. 3.
Figure 7:
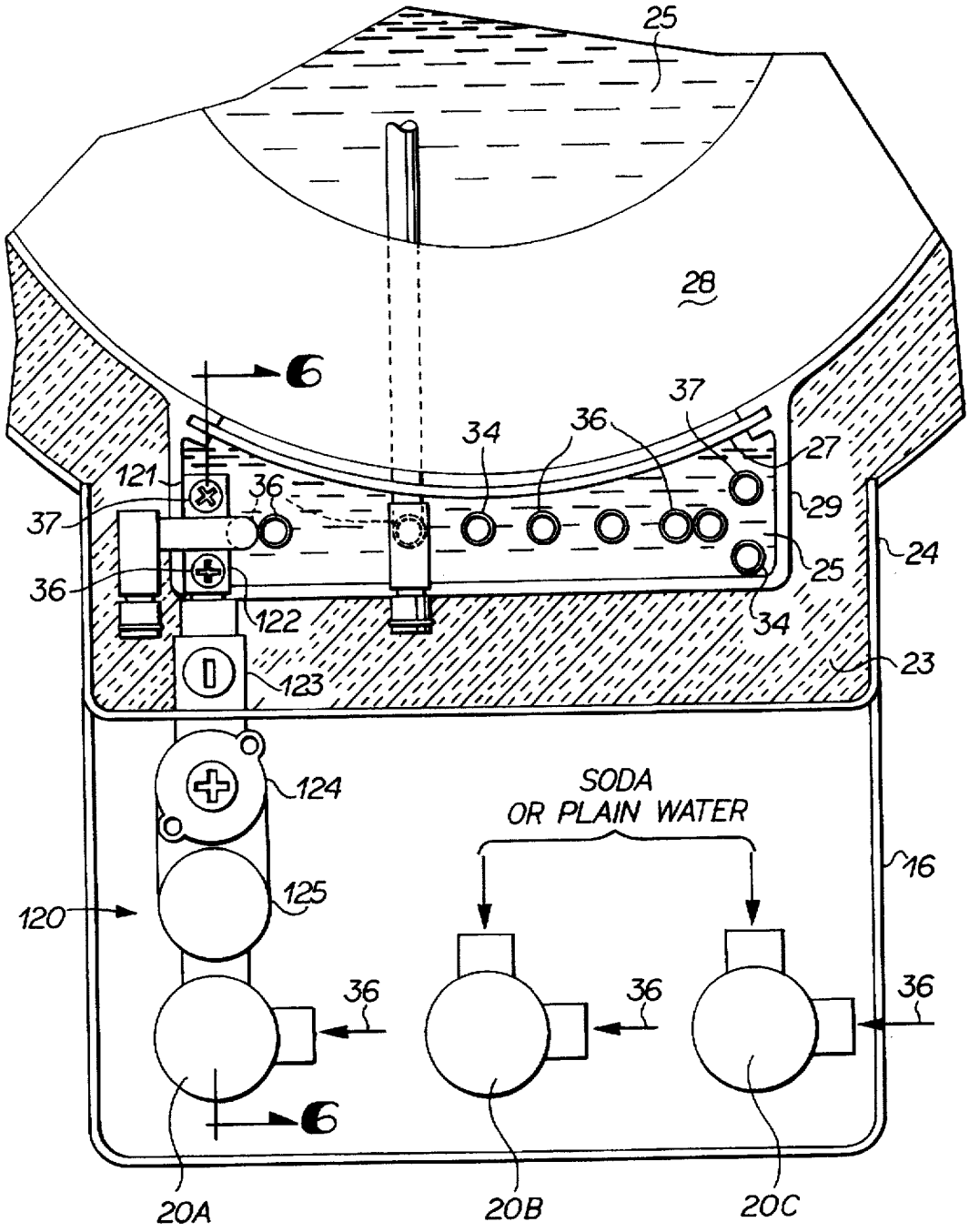
FIG. 7 is a partial top plan view of the dispenser housing of FIG. 3, and the associated nozzle housing.

Suitable valve assemblies 120 for use within the valve housing 16 of FIG. 3 are illustrated in FIG. 6 in conjunction with FIG. 7. The lower portion of FIG. 6 is a partial cross-sectional view taken along lines 6—6 of FIG. 7. This view depicts a valve assembly generally indicated 120 including a conduit 35 with a plurality of in-line valves 121, 122, 123 and 125; and an in-line flow regulator 124. Valve 121 is a manually operable valve disposed in plain (still) water line 37. Valve 122 is a manually operable valve disposed in carbonated (soda) water line 34. These valves may be selectively opened or closed to preset the dispensing of either plain water or soda water to dispenser nozzle 20A, as desired when the dispenser is set up for use. Valve 123 is simply a shut-off valve to open or block the flow of any fluid through conduit 35 to mixing nozzle 20A. Solenoid valve 125 is provided and is actuable in response to actuation of an appropriate one of selector buttons 18 on the face of valve housing 16. Flow regulator 124 is a spring-biased flow regulator of any suitable type. Flow regulator 124 could for example be of an improved type illustrated in FIG. 17 to be described hereinafter.

It should be noted that nozzle 20A, as depicted in FIG. 6, is rotated 90° for clarity to illustrate the relative location of the respective bores therein and connection to the water and syrup lines.

The top portion of FIG. 6, illustrates a somewhat similar valve assembly 120' supplying syrup to nozzle 20A. Water and soda valves 121, 122 are not needed. However, a shut-off valve 123, a flow regulator 124 and a solenoid valve 125 are provided as in the water supply valve assembly 120 in the lower half of FIG. 6.

Each syrup path through conduit 36 would include a valve assembly such as 120' in fluid communication therewith. Only one such valve assembly is shown for clarity but it should be noted that two syrup conduits 36A, 36B are illustrated as being connected to the input of nozzle 20A. These conduits communicate with passages 19A, 19B, respectively, within nozzle 20A to supply syrup of two different flavors for mixing with soda water output through solenoid 125 to annular chamber 21.

The water conduits 34 containing soda water dispensed from carbonator 30, syrup conduits 36 and still (plain) water conduits 37 are input to the nozzles 20A, 20B, 20C of FIG. 7 and their associated valve assemblies after the fluids therein have passed through the water bath. A bulge 29 in the cylindrical wall is provided for these conduits as illustrated in FIG. 7 and includes a baffle plate 27 adjacent to the ice bank 28. The chamber between baffle 27 and bulge 29 is part of the water bath and the water therein chills the contents of these conduits. It should be noted that only one valve assembly 120 is illustrated in FIG. 7 for the purposes of clarity of illustration, and that similar valve assemblies 120 would be connected as shown for the input of soda or plain water to the nozzles 20B, 20C. Likewise none of the syrup supply valve assemblies 120' are illustrated in FIG. 7 for clarity of illustration. However, it should be understood that these valve assemblies exist and would be connected as illustrated in the top portion of FIG. 6.

Figure 8:
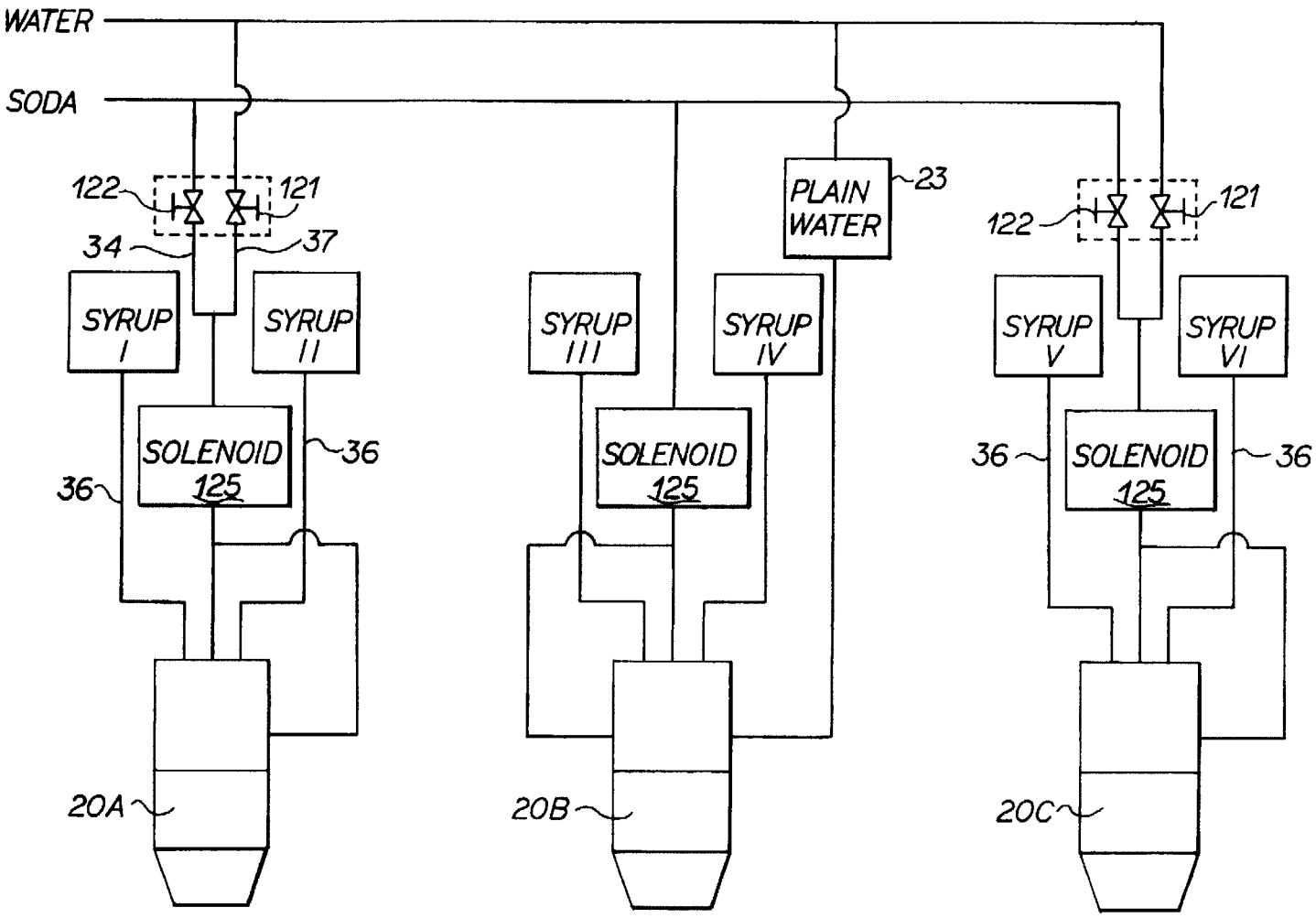
FIG. 8 is a schematic block diagram of a preferred valve and nozzle assembly and supply conduit system of the present invention for the dispenser of FIG. 3.

The ability of system of the present invention to dispense a plurality of preselected flavors from three dispenser nozzles is further illustrated in FIG. 8. Each of the nozzles 20A, 20B, 20C may selectively dispense two different flavors of beverage as determined by six different flavors of syrup I–VI as illustrated in FIG. 8. The flavors selected for dispensing by each of the respective nozzles are chosen to be compatible for purposes of minimizing flavor carry over problems. That is, for example, syrups I or II, alternately selected for dispensing from nozzle 20A, would be flavors which would not tend to cause flavor carry over problems with respect to each other. The same considerations would be given to the selection of flavors III, IV, for nozzle 20B and V, VI for nozzle 20C. If a particularly pungent flavor is utilized, which would almost always present some type of flavor carry over problem, that pungent flavor could be dispensed from nozzle 20B as a dedicated nozzle for that flavor.

Referring in more detail to FIG. 8 it can be seen that the water/soda selection valves 121, 122 described hereinbefore with respect to FIGS. 6 and 7 are disposed in the water input lines of nozzles 20A and 20B. Nozzle 20B is provided with a slightly different water supply arrangement in that water is provided through a plain water solenoid 23 directly to nozzle 20B and soda water is provided through a soda water solenoid 125. These respective solenoids 123 and 125 are selectively actuated depending on whether or not plain water, or a carbonated post-mix beverage, are selected by one of the buttons 18 on the selection panel.

Various embodiments for enhancing the marketing appeal of the drink dispenser of the present invention are illustrated in FIGS. 9 to 11 and 13 to 15. In each of these embodiments a decorative sleeve is placed about the cylindrical can of the dispenser of FIG. 1 to simulate the appearance of a beverage bottle, glass or serving cup.

Figure 9:
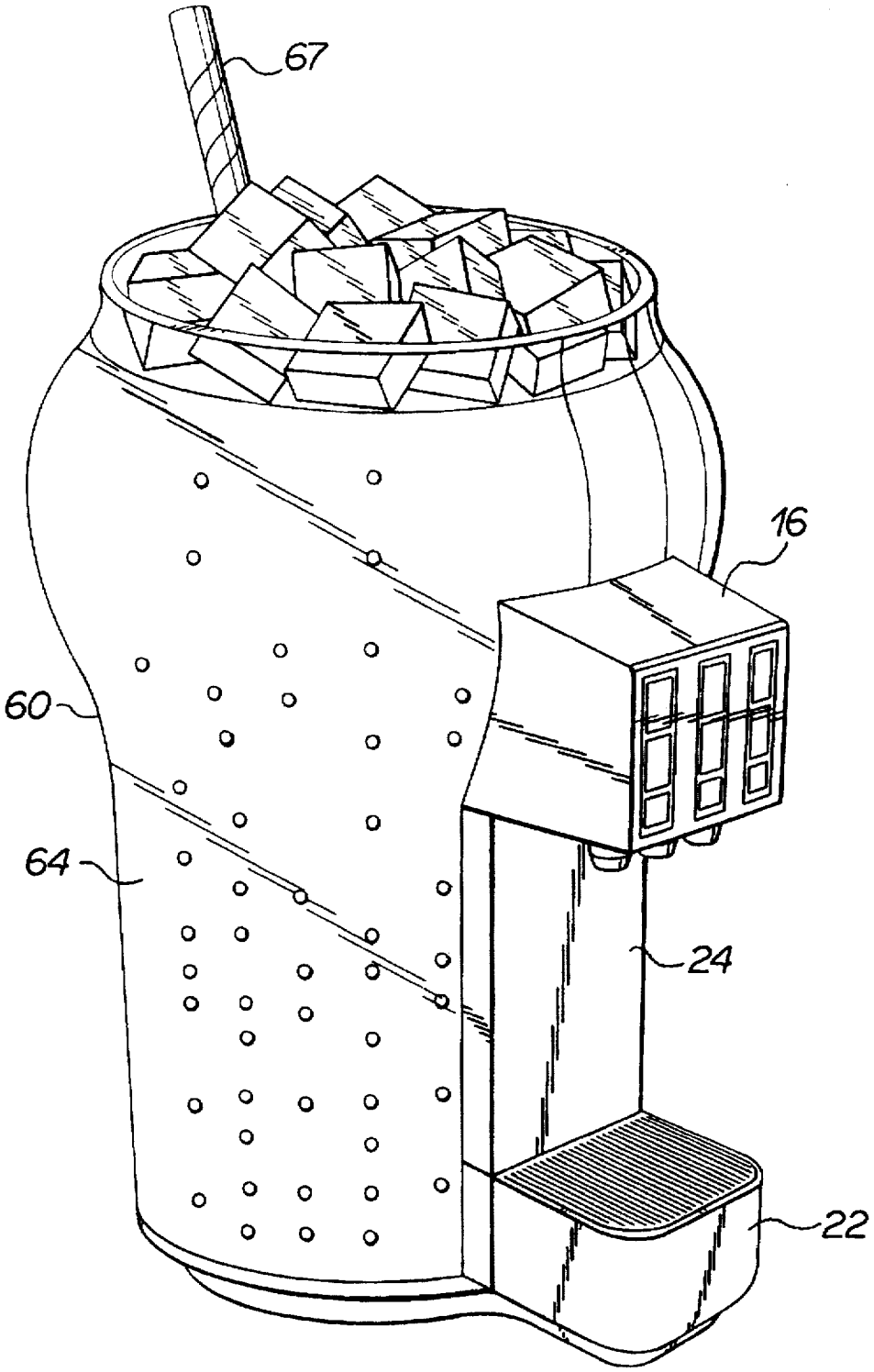
FIGS. 9 and 10 are a perspective and side elevational view, respectively, of another embodiment of the dispenser of the present invention including a decorative sleeve disposed about the cylindrical housing of the dispenser of FIG. 1, shaped to simulate the appearance of a bell-shaped glass and including a jacket of bubbling fluid, and a cap of simulated ice and a drinking straw.
Figure 10:
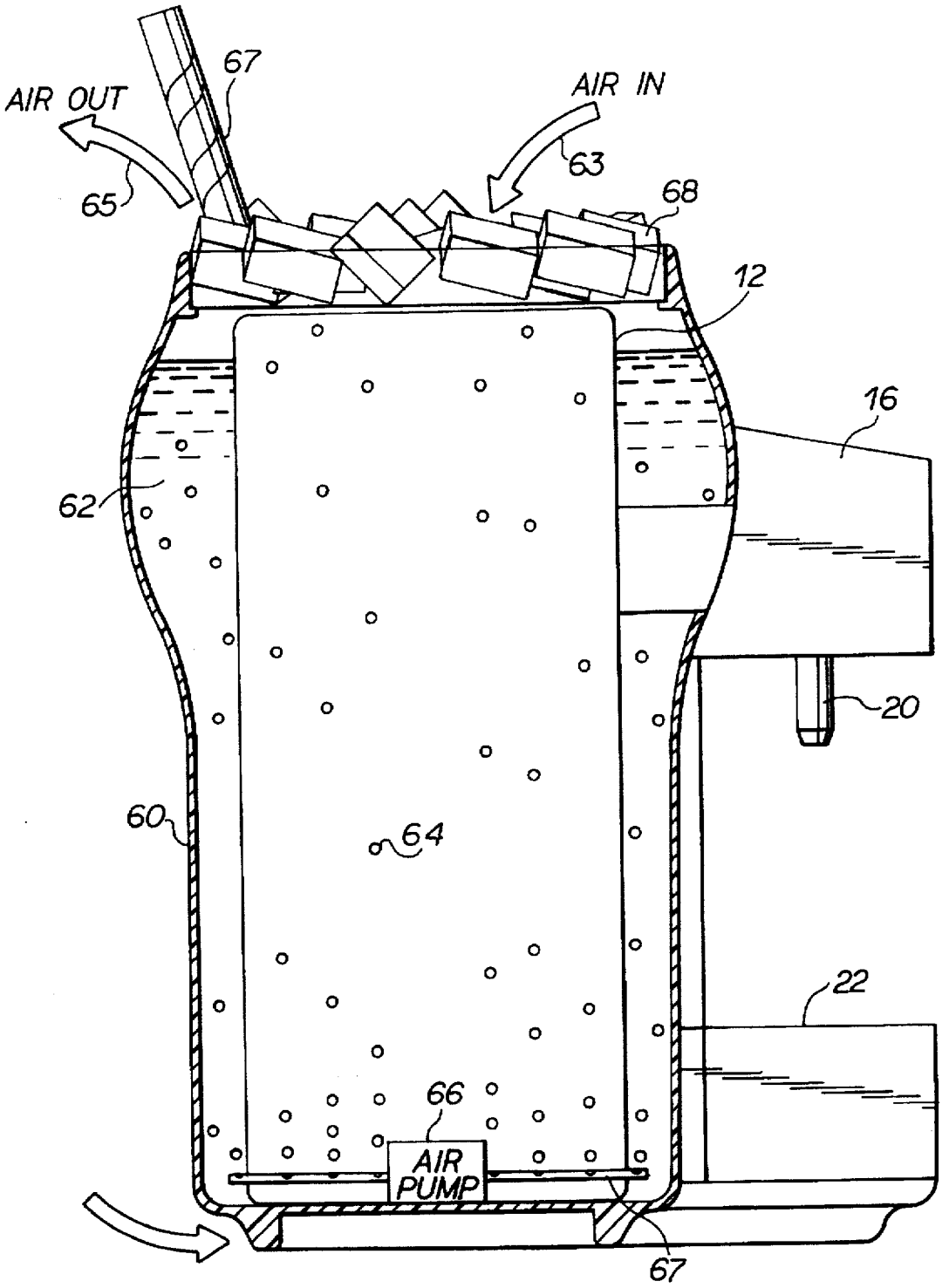

In one embodiment of a decorative sleeve is depicted in FIGS. 9 and 10. In this embodiment the decorative sleeve 60 comprises a bell-shaped drinking glass having transparent exterior walls surrounding cylindrical can 12 and spaced therefrom in the provision of an annular jacket in which a beverage colored liquid 62 is disposed. In the bottom of sleeve 60 is an air pump 66 having an aperture tube 67 extending therefrom about the annular jacket in order to inject air bubbles 64 into fluid 62. These air bubbles give the appearance of a bubbling, effervescent, carbonated beverage within bell-shaped glass 62. In order to make the beverage look as authentic as possible the exterior surface of cylindrical housing 12 may be painted the same color as liquid 62. The sleeve or glass 60 may also be provided with a decorative cap including translucent chunks of simulated ice 68 and a drinking straw 67 extending therefrom. Suitable apertures are provided in the decorative cap in order to permit the influx of air at 63 and the output of air at 65.

Figure 11:
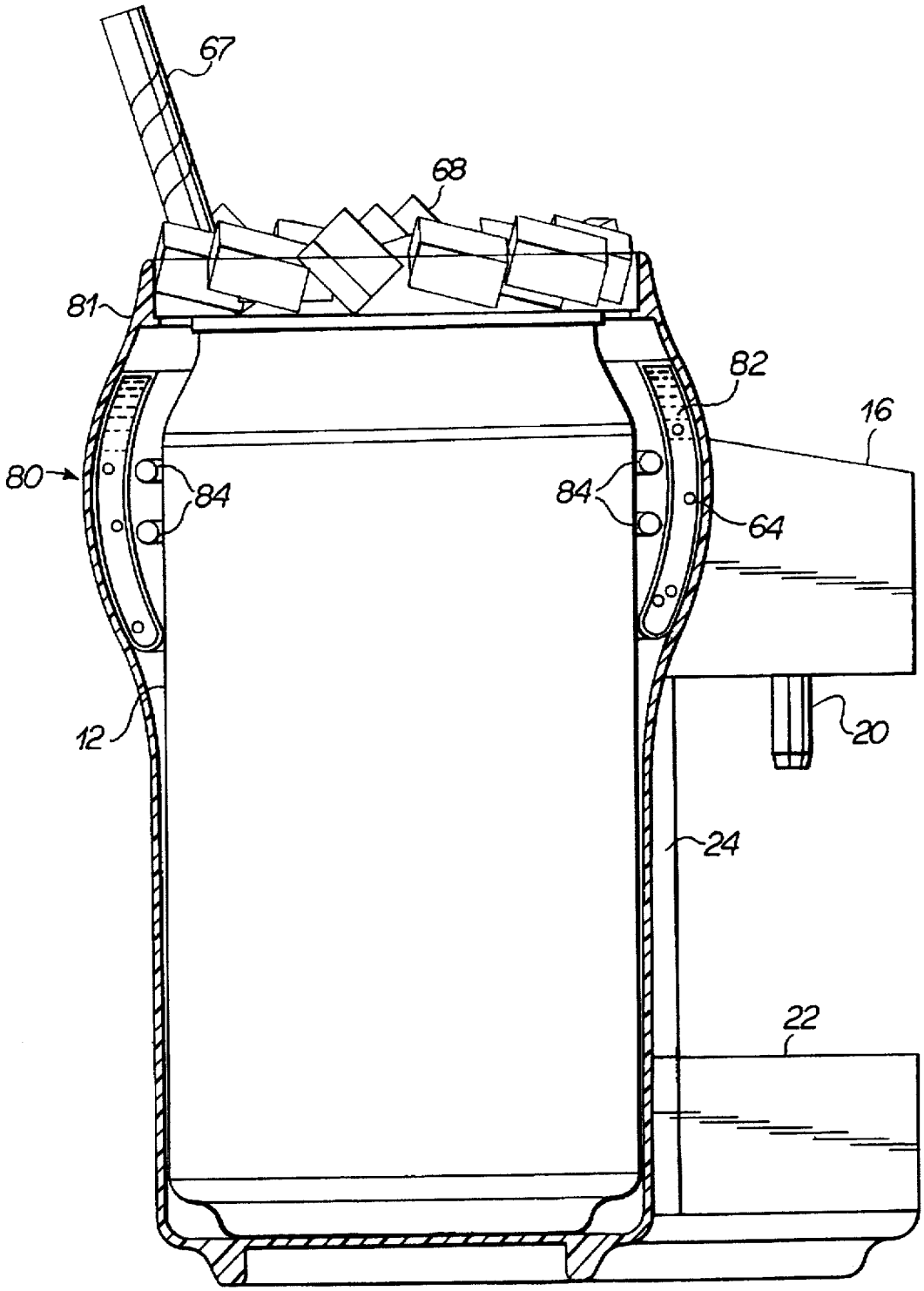
FIG. 11 is another embodiment of the dispenser of the present invention illustrating a simulated bell-shaped glass formed from a partial sleeve of bowed transparent material disposed about the cylindrical housing of the beverage dispenser of FIG. 1.

Referring to FIG. 11 there is illustrated a modified form of the bell-shaped glass embodiment of FIGS. 9 and 10 formed by a partial sleeve 80 disposed only about the upper portion of cylindrical can 12. Decorative sleeve 80 includes a decorative cap portion 81 which simulates the top opening and rim of the bell-shaped glass and a downwardly depending and bowed skirt portion 82 which concentrically surrounds the top portion of can 16. If desired, a light 84 may be provided in the annular space between sleeve 82 and the exterior walls of can 12 to back light bubbling liquid within the space between the inner and outer walls of sleeve portion 82. That is, sleeve portion 82 is a double walled structure of the type illustrated in the FIG. 5 embodiment, and has liquid of the color of the beverage therein with air bubbles to simulate the appearance of a carbonated beverage. The bottom half of cylinder 12 in this embodiment would be painted the same color as the liquid within sleeve portion 82, so that the overall appearance of the housing of the beverage dispenser in FIG. 11 simulates the appearance of a bell-shaped beverage glass filled with the beverage to be consumed. The cap portion 81 may also be provided with translucent chunks of simulated ice 68 and a drinking straw 67 extending therefrom if desired.

Figures 12A, 12B:
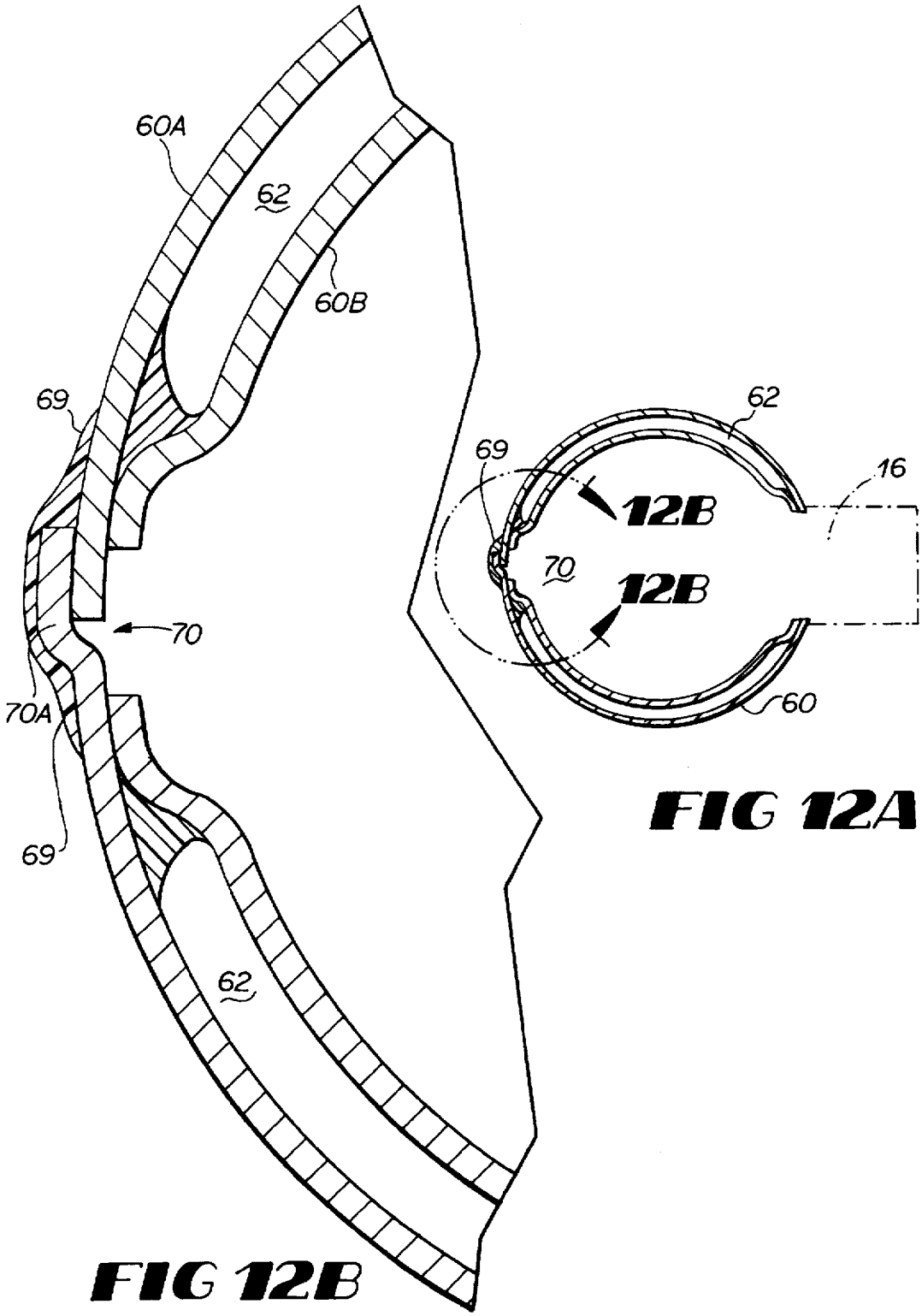
FIG. 12A is a top plan view of the dispenser of FIG. 11 and the associated decorative sleeve.
FIG. 12B is an enlarged cross-sectional view of a seamed portion of the decorative sleeve of FIG. 12A.

Referring to FIG. 12A further details of decorative sleeve 60 are illustrated. Sleeve 60 for example has a seam 70 and a cut-out 60A so that it may be wrapped around cylindrical housing 12. Cut-out 60A is provided to accommodate the valve assembly 16, the nozzle 20 and the drip tray 22.

An enlarged cross-sectional view of seam 70 is illustrated in FIG. 12B. Seam 70 has overlapping end portions 70A and 70B which may be glued or heat-sealed together. On the exterior surface of sleeve 60 a coating or paint 69 may be provided in the region of the seam in the same color as the liquid 62 within the annular chamber or jacket so that seam 70 is virtually invisible to a customer. Sleeve 60 is a double walled structure including inner and outer cylinders 60A and 60B for accommodating the liquid 62 therebetween and in the regions adjacent to seam 70 a silicone sealant material 61 is provided at the juncture between end portions of walls 60A, 60B in order to preclude leakage of liquid 62 at regions adjacent seam 70.

Figure 14:
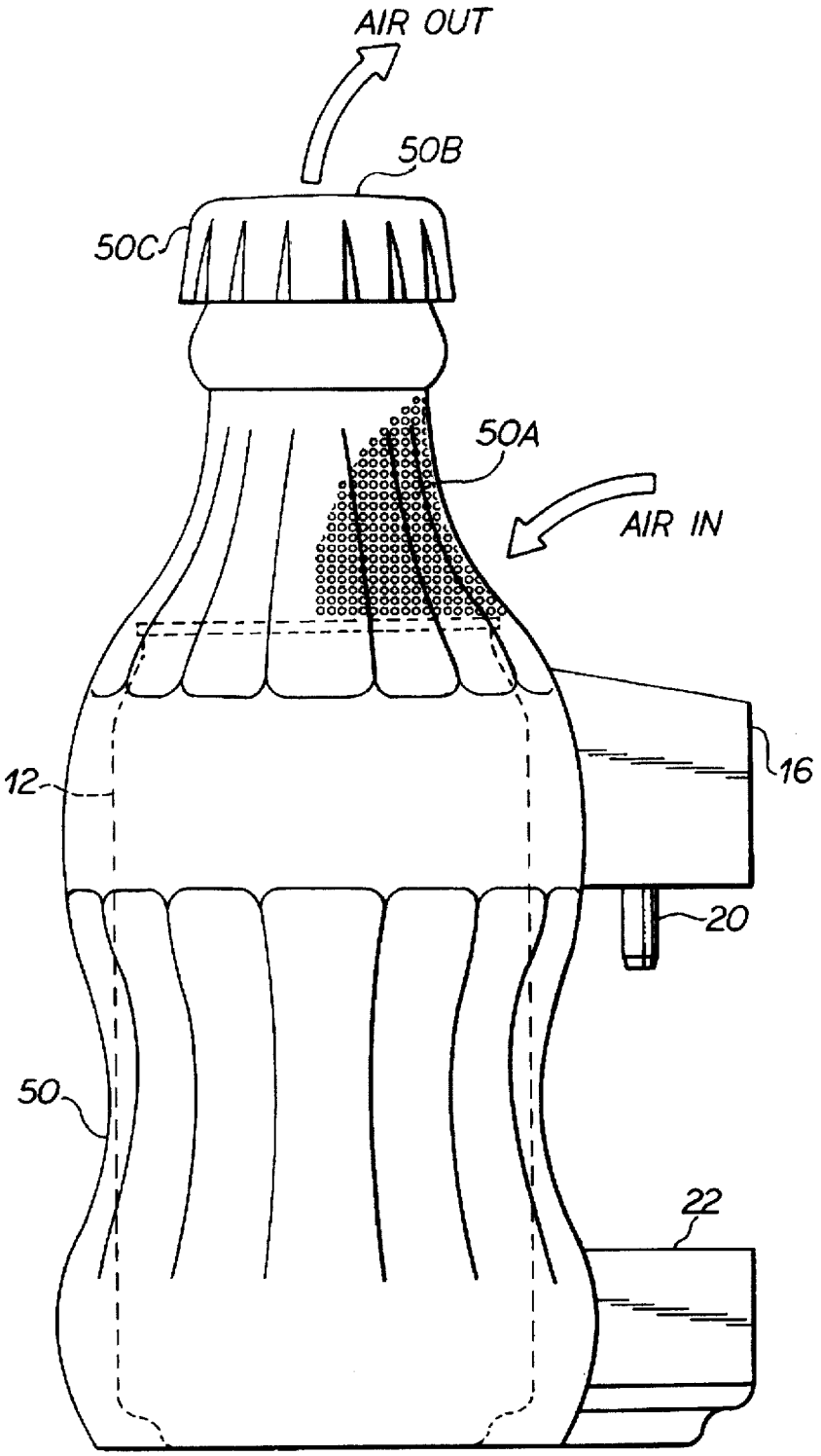
FIG. 14 is a side elevational view of another embodiment of a decorative sleeve disposed about the dispenser of FIG. 1 shaped to simulate a bottle of beverage.

It should be understood that the double walled structure with a liquid such as 62 therebetween for simulating the appearance of a bubbling, effervescent beverage may also be utilized in the embodiment of FIG. 14 which depicts or simulates a bottle of beverage.

Figure 13:
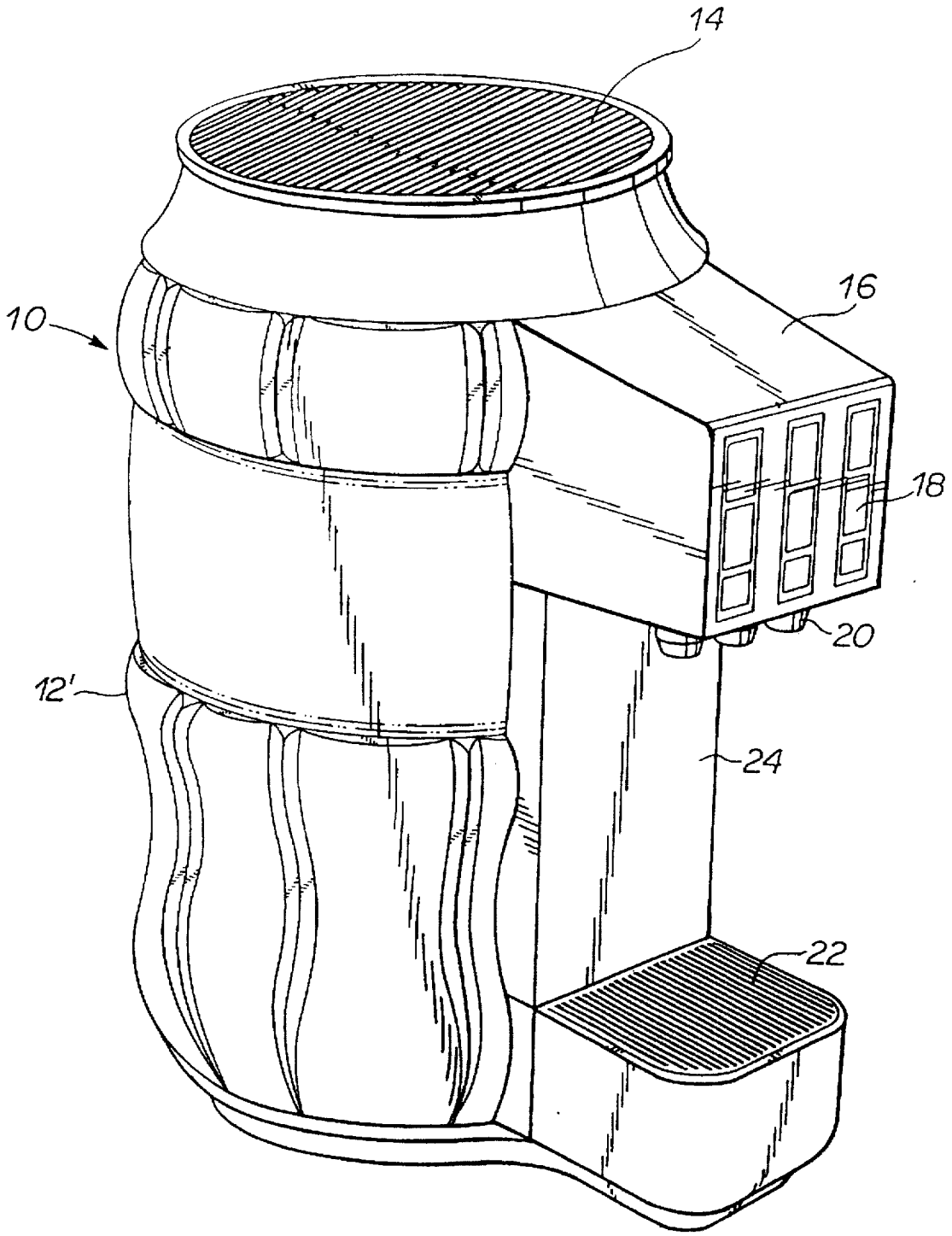
FIG. 13 is a perspective view of another embodiment of a decorative sleeve in the shape of a can with fluted sidewalls.

FIG. 13 illustrates another embodiment wherein a can-shaped decorative sleeve 12' with fluted sidewalls is provided.

Referring to FIG. 14 there is illustrated another embodiment of a decorative sleeve 50 in the shape of Coca-Cola's fluted, contour, bottle. This bottle shape is a registered trademark of The Coca-Cola Company. Sleeve 50 is installed around cylindrical housing or can 12 as a base in any suitable manner. The interior surface of sleeve 50 is relieved in a complimentary shape to the exterior shape of cylindrical can 12 to provide a snug and secure fit thereabout. Sleeve 50 may be provided with a seam (not shown) on its rear surface so that it may be simply wrapped around can 12 and secured at the seam. A cut-out is provided in the front wall of sleeve 50 to accommodate valve assembly 16 and drip tray 22. A grid 50A may be provided in the neck portion of sleeve 50 to accommodate the flow of air into the sleeve and thus the cylindrical housing 12. A simulated bottle cap 50C is provided on the top of sleeve 50 and may be provided with a grille or other type of apertures to 50B in order to accommodate the flow of air out of sleeve 50.

Figure 15:
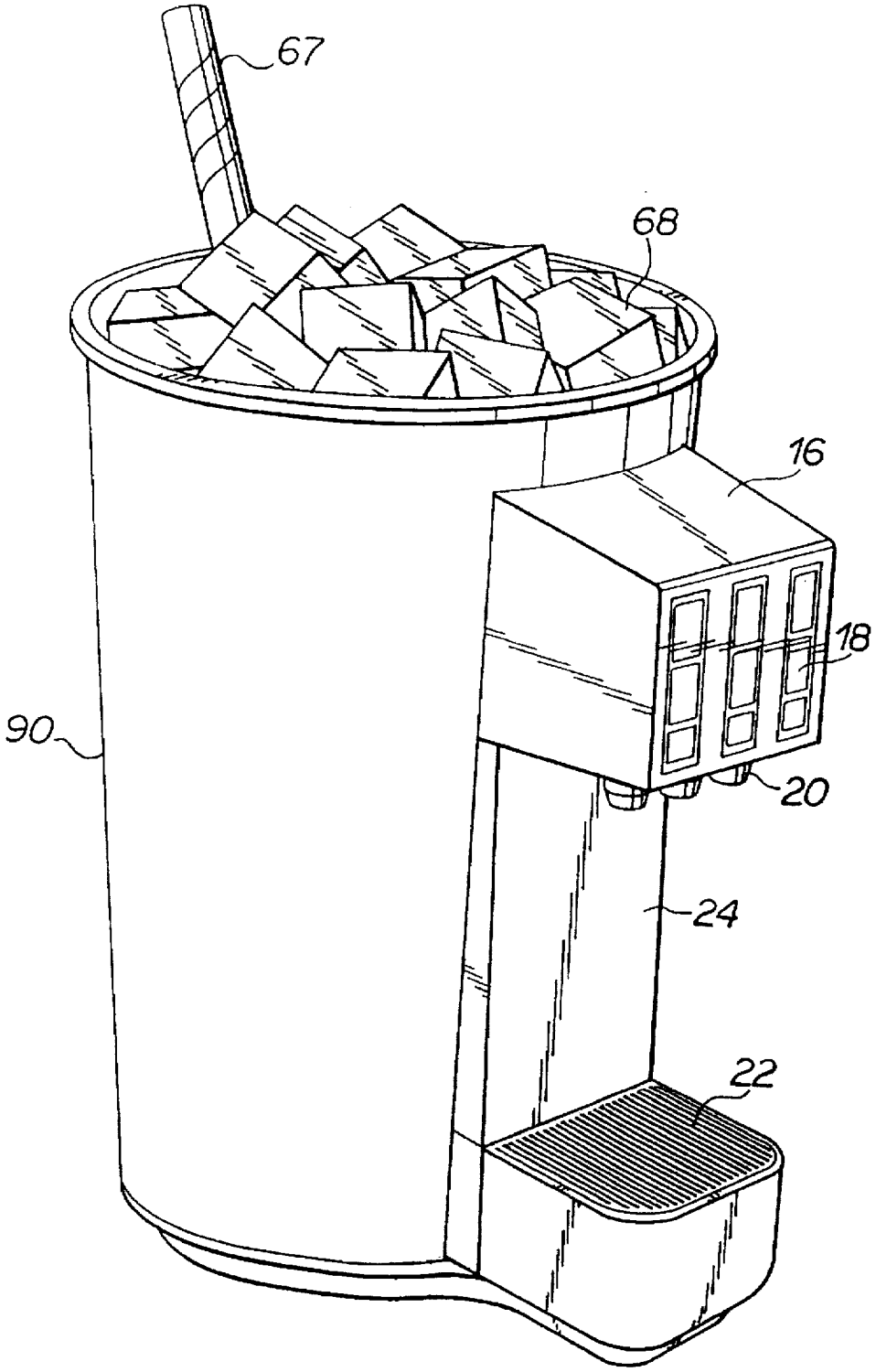
FIG. 15 is a perspective view illustrating still another embodiment of a decorative frusto-conical sleeve, and associated decorative cap of ice and drinking straw are disposed about the cylindrical housing of the dispenser of FIG. 1 which simulates the appearance of a cup of beverage.

FIG. 15 illustrates still another embodiment of the present invention which simulates the appearance of a serving cup for the beverage to be consumed. This serving cup comprises a frusto-conical decorative sleeve 90 which may be secured about cylindrical can 12 in a similar manner to the other embodiments of simulated beverage containers described hereinbefore. The serving cup simulated by sleeve 90 also may include simulated chunks of ice 68 and a drinking straw 67 extending therefrom.

Figure 16:
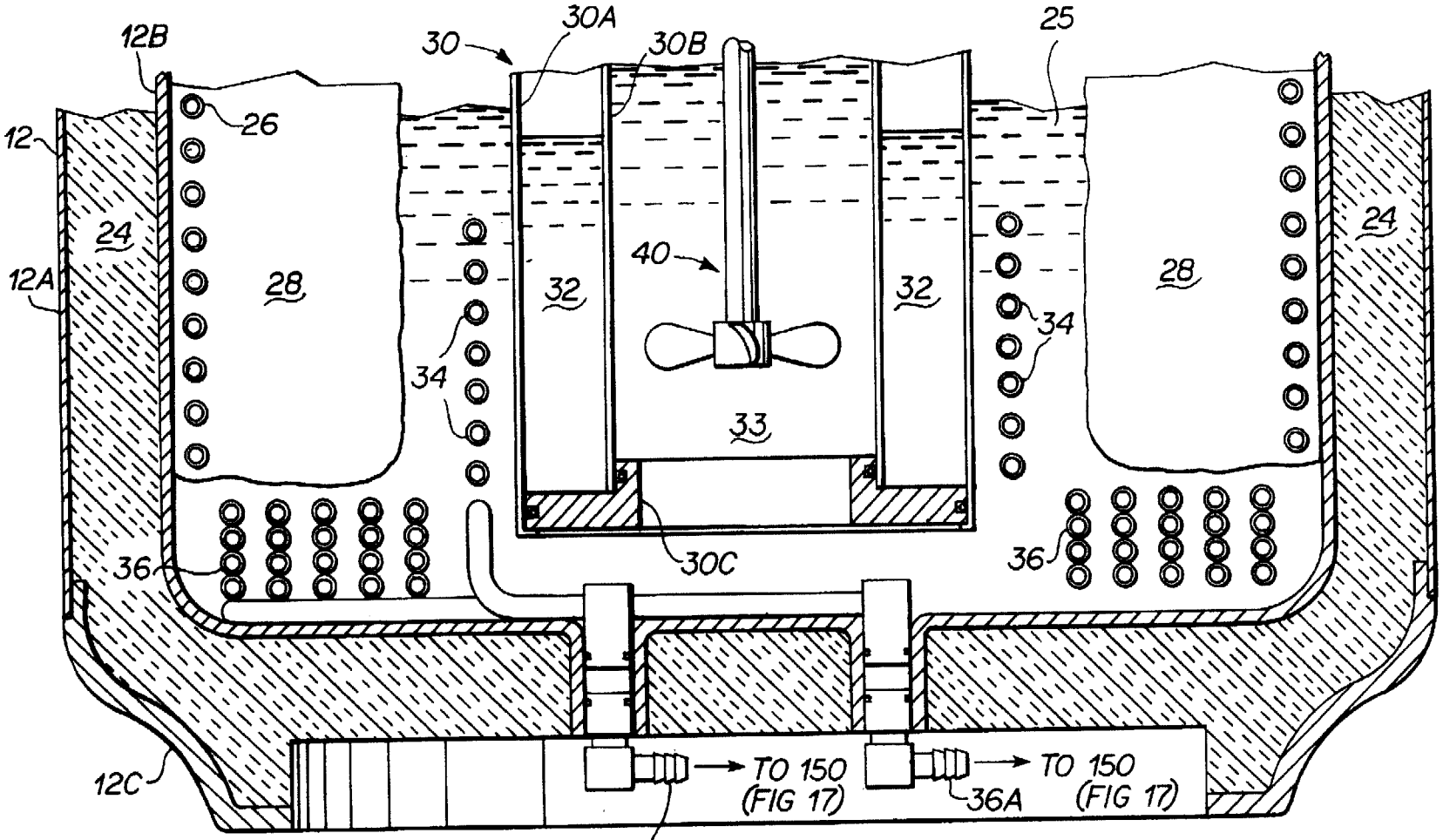
FIG. 16 is a partial cross-sectional view of the bottom portion of an alternate embodiment of the beverage dispenser of FIGS. 1 and 3 illustrating an alternative location of syrup coils below the cylindrical ice bank and in-line flow regulators upstream of the water bath.

FIG. 16 is a cross-sectional view of a bottom portion of a housing 12 of the dispenser of the present invention illustrating an alternate embodiment for the location of the syrup conduits 36 and the use of in-line flow regulators 38 upstream of the water bath for each of the respective input fittings 34A for water to be carbonated and 36A for syrup. Flow regulators 38 would be coupled by hoses from output fitting 150 (FIG. 17) to fittings 34A and 36A in FIG. 16. It is advantageous to place in-line flow regulators in the product lines upstream of the water bath where temperatures are higher. At high temperatures, changes in temperature have a proportionately smaller effect on viscosity s compared to cold temperatures. However, more compact, easily adjustable, in-line flow regulators are needed at the input side of the water bath because they are usually disposed at relatively inaccessible locations.

Figure 17:
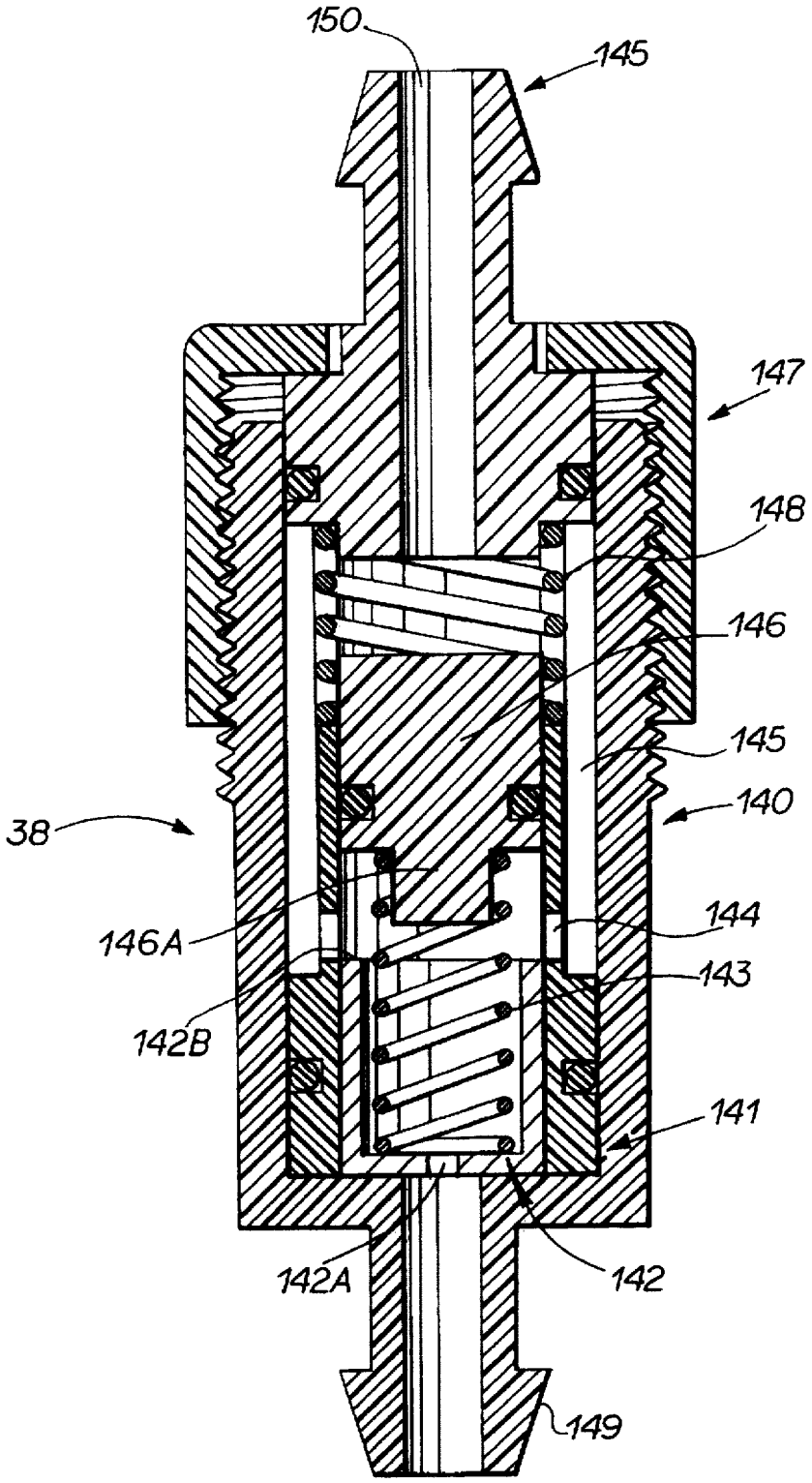
FIG. 17 is a cross-sectional view of a straight, in-line flow regulator for use in the water and syrup product lines of the dispenser in the embodiment of FIG. 16 of the present invention upstream of the water bath.

The details of an improved in-line flow regulator 38 are illustrated in FIG. 17. All components are disposed in a straight line on a common longitudinal axis resulting in an easily adjustable compact structure. Regulator 38 includes a cylindrical housing 150 with an input coupling 149 and an output coupling 140 aligned on the common longitudinal axis. A fixed cylindrical sleeve 141 disposed within housing 140 has a series of spaced flow control apertures 144 therethrough about its circumference which communicate with an annular passage 145. Spring 148 holds sleeve 141 in place and abuts a top end of a movable plug 146. The effective size of apertures 144 varies with the position of a piston 142 which is longitudinally movable within sleeve 141 such that a top edge 142B thereof moves across apertures 144 to vary the effective size thereof. The bottom of piston 142 has an aperture 142A therein. Accordingly, fluid flows through regulator 38 via input coupling 149, aperture 142A, apertures 144, annular passage 145 and the radial and longitudinal passages inside of output coupling 150.

Piston 142 is spring-biased by coil spring 143, which is compressed or expanded in response to pressure changes in the fluid flowing through regulator 38, thereby changing the effective size of apertures 144. Spring 143 is located between the bottom of piston 142 and the bottom of plug 146. Therefore, the flow rate of fluid passing through regulator 38 is maintained substantially constant in spite of pressure changes in the fluid for each manual setting of an adjusting nut 147.

Adjusting nut 147 is concentrically disposed on the outside of housing 140 and is threaded thereto. Rotation of nut 147 adjusts the flow rate of fluid through regulator 38. Tightening of nut 147 pushes down on plug 146 compressing spring 143 thereby increasing the effective force of spring 143 and reducing flow rate. Loosening of nut 147 decreases the effective force of spring 143 and increases flow rate.

Nut 147 may be easily grasped by the fingers of an operator to adjust flow rate even when regulators 38 are disposed in hard-to-reach locations such as the recess in the bottom of the dispenser in FIG. 16. This flow regulator is thus easier to adjust because no tools are required. Also, the in-line construction makes installation easier than the known devices which have a 90° bend requiring an elbow (with its pressure digs) to achieve the in-line result.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A refrigeration assembly for a post-mix beverage dispenser comprising:

a cylindrical housing for containing a supply of water forming a water bath;

a cylindrical carbonator tank disposable within said cylindrical housing and the water bath, said carbonator tank including first and second concentric cylinders defining an annular chamber for carbonated water therebetween, an inner one of the concentric cylinders defining a central bore for accommodating refrigerated water from the water bath therein; and a circular evaporator coil concentrically disposed within the cylindrical housing for cooling the water in the water bath and the carbonator tank and forming an annular ice bank around an inner surface of the housing;

major flow paths of water through the cylindrical housing and around the carbonator tank being substantially circular.

2. The refrigeration assembly of claim 1 further including agitator means disposed within said central bore for circulating water from the water bath therein.

3. A carbonator assembly for use in a refrigerated water bath comprising:

first and second concentric cylinders defining an annular chamber for carbonated water therebetween, an inner one of the concentric cylinders defining a central bore for accommodating refrigerated water from the water bath therein;

water circulation means for supplying water to be carbonated to the annular chamber and outputting carbonated water therefrom; and $CO_2$ gas supply means for supplying $CO_2$ gas to the water in the annular chamber in order to carbonate the same.

4. The carbonated assembly of claim 3 further including agitator means disposed within said central bore for circulating water from the water bath therein.

5. A post-mix beverage dispenser comprising:

a cylindrical housing for containing a supply of water forming a water bath;

a cylindrical carbonator tank disposable within said cylindrical housing and the water bath;

an evaporator coil having circular courses concentrically disposed within the cylindrical housing for cooling the water in the water bath and the carbonator tank and forming an annular ice bank of substantially uniform thickness around an inner surface of the housing;

water conduit means for supplying water to be carbonated to the carbonator and outputting carbonated water therefrom through carbonated water conduit means, major portions of flow paths through the water conduit means having no flow impeding corners or bends;

$CO_2$ gas supply means for supplying $CO_2$ gas to the water in the carbonator tank in order to carbonate the same;

syrup conduit means extending through said water bath, major portions of flow paths through said syrup conduit means having no flow impeding corners or bends; and a valve assembly connected to an outside surface of the cylindrical housing in fluid communication with said carbonated water and syrup conduit means for dispensing post-mix beverages, said valve assembly being in fluid communication with at least one dispensing nozzle;

major flow paths of fluid through each of the cylindrical housing, the water conduit means, syrup conduit means, and around the carbonator tank being substantially circular.

6. The dispenser of claim 5 wherein the major portions of the carbonated water conduit means comprise circular courses concentrically disposed about the carbonator tank.

7. The dispenser of claim 6 wherein the major portions of the syrup conduit means comprise circular courses concentrically disposed within the cylindrical housing.

8. The dispenser of claim 5 wherein the major portions of the syrup conduit means comprise circular courses concentrically disposed within the cylindrical housing.

9. The dispenser of claim 5 wherein said cylindrical housing is shaped and ornamented to simulate the appearance of a container in which the post-mix beverage could be served.

10. The dispenser of claim 9 wherein said container is a beverage can.

11. The dispenser of claim 9 wherein said container is a beverage bottle.

12. The dispenser of claim 9 wherein said container is a beverage cup.

13. The dispenser of claim 9 wherein said container is a beverage glass.

14. The dispenser of claim 13 wherein the glass comprises a decorative sleeve surrounding the cylindrical housing.

15. The dispenser of claim 14 further including fluid between the decorative sleeve and cylindrical housing for simulating the appearance of a beverage in the glass.

16. The dispenser of claim 15 further including air bubbles within the fluid for simulating the appearance of a carbonated beverage in the glass.

17. The dispenser of claim 16 further including a decorative caps for the glass including simulated chunks of ice and a drinking straw extending therefrom.

18. The dispenser of claim 11 wherein the bottle comprises a decorative sleeve surrounding the cylindrical housing.

19. The dispenser of claim 12 wherein the cup comprises a decorative sleeve surrounding the cylindrical housing.

20. The dispenser of claim 19 further including a decorative cap for the cup including simulated chunks of ice and a drinking straw extending therefrom.

21. The post-mix beverage dispenser of claim 5 wherein the carbonation tank includes first and second concentric cylinders defining an annular chamber for carbonated water therebetween, an inner one of the concentric cylinders defining a central bore for accommodating refrigerated water from the water bath therein.

22. A refrigeration system for a post-mix beverage dispenser comprising:

a housing for containing a supply of water forming a water bath;

a carbonator tank disposable within said housing and the water bath;

coolant circulation components including a compressor, condenser and an evaporator coil for refrigerating water in said water bath;

an electrical subassembly including a group of electrical components for controlling and operating the refrigeration system, said electrical subassembly not including components which are plumbed in fluid communication with said coolant circulation components;

a deck in said housing for removably supporting said coolant circulation components; and a removable bracket for separately supporting and removing the electrical subassembly from the housing;

the electrical subassembly being readily removable for maintenance without removing coolant circulation components and the electrical subassembly including at least one of an agitator assembly for circulating water in said water bath and a fan assembly for circulating air through the condenser and the housing.

23. The system of claim 22 wherein said electrical subassembly includes both of the agitator assembly for circulating water in said water bath and the fan assembly for circulating air through the condenser and the housing.

24. The refrigeration assembly of claim 1 further including:

coolant circulation components including a compressor, condenser and an evaporator coil for refrigerating water in said water bath;

an electrical subassembly including a group of electrical components for controlling and operating the refrigeration system, said electrical subassembly not including components which are plumbed in fluid communication with said coolant circulation components;

a deck in said housing for removably supporting said coolant circulation components; and a removable bracket for separately supporting and removing the electrical subassembly from the housing;

the electrical subassembly being readily removable for maintenance without removing the coolant circulation components.

25. The system of claim 24 wherein said electrical subassembly includes an agitator assembly for circulating water in said water bath and a fan assembly for circulating air through the condenser and the housing.

26. The dispenser of claim 5 further including:

coolant circulation components including a compressor, condenser and an evaporator coil for refrigerating water in said water bath;

an electrical subassembly including a group of electrical components for controlling and operating the refrigeration system, said electrical subassembly not including components which are plumbed in fluid communication with said coolant circulation components;

a deck in said housing for removably supporting said coolant circulation components; and a removable bracket for separately supporting and removing the electrical subassembly from the housing;

the electrical subassembly being readily removable for maintenance without removing the coolant circulation means.

27. The system of claim 26 wherein said electrical subassembly includes an agitator assembly for circulating water in said water bath and a fan assembly for circulating air through the condenser and the housing.

28. The dispenser of claim 5 further comprising fluid flow regulators in the syrup and carbonated water conduit means for controlling the flow rate of fluid therein including:

a housing having a longitudinal axis and input and output ports disposed on said axis;

a piston disposed in said housing for movement along the axis in response to pressure changes of the fluid;

adjustable passage means in said housing between the input and output ports having an effective passage size responsive to the movement and position of said piston;

spring means for biasing said piston with an adjustable force determinative of the effective passage size; and a collar concentrically disposed on the outside of said housing for adjusting the force of the spring means, said collar being manually adjustable by the fingers of an operator.

* * * * *